US011841122B2

(12) United States Patent
Syre et al.

(10) Patent No.: US 11,841,122 B2
(45) Date of Patent: Dec. 12, 2023

(54) MOTOR VEHICLE LIGHT MODULE COMPRISING AN ELECTROCHROMIC DEVICE

(71) Applicant: VALEO VISION, Bobigny (FR)
(72) Inventors: Matthieu Syre, Bobigny (FR); Stephane Winterstein, Bobigny (FR); Blaise Jars, Bobigny (FR); Gavin Warner, Bobigny (FR); Sylvain Giraud, Bobigny (FR)
(73) Assignee: VALEO VISION, Bobigny (FR)

( * ) Notice: Subject to any disclaimer, the term of this patent is extended or adjusted under 35 U.S.C. 154(b) by 0 days.
(21) Appl. No.: 17/929,010
(22) PCT Filed: Feb. 10, 2021
(86) PCT No.: PCT/EP2021/053114
§ 371 (c)(1),
(2) Date: Aug. 10, 2022
(87) PCT Pub. No.: WO2021/170400
PCT Pub. Date: Sep. 2, 2021
(65) Prior Publication Data
US 2023/0070403 A1 Mar. 9, 2023
(30) Foreign Application Priority Data
Feb. 27, 2020 (FR) ..... 2001932
Feb. 27, 2020 (FR) ..... 2001935
(51) Int. Cl.
*F21S 41/64* (2018.01)
*F21S 41/265* (2018.01)
(Continued)
(52) U.S. Cl.
CPC ..... *F21S 41/645* (2018.01); *F21S 41/148* (2018.01); *F21S 41/265* (2018.01); *F21S 41/285* (2018.01);
(Continued)
(58) Field of Classification Search
CPC ..... F21S 41/645
See application file for complete search history.

(56) References Cited

U.S. PATENT DOCUMENTS 7,252,418 B2 * 8/2007 Enders ..... B60Q 3/74 362/465
8,253,417 B2 * 8/2012 Pislak ..... G01V 3/22 166/250.1
(Continued)

FOREIGN PATENT DOCUMENTS

DE 10 2017 208 984 A1 11/2017
DE 10 2017 214 656 A1 2/2019
(Continued)

OTHER PUBLICATIONS

International Search Report dated Apr. 20, 2021 in PCT/EP2021/053114 filed on Feb. 10, 2021 (citing references 1-5, & 15-22 therein, 3 pages).
(Continued)

*Primary Examiner* — Robert J May
(74) *Attorney, Agent, or Firm* — Oblon, McClelland, Maier & Neustadt, L.L.P.

(57) ABSTRACT

A light module of a motor vehicle lighting device. The light module includes a light source intended to perform at least one photometric function, and an electrochromic device including at least one portion arranged downstream of the light source and capable of optionally having a diffusing appearance or a transparent appearance. A controller is arranged to receive an emission instruction from the photometric function and to control, in accordance with the instruction, the emission of light by the light source and the appearance of the electrochromic device.

20 Claims, 5 Drawing Sheets

(51) Int. Cl.

| | |
|---|---|
| ***F21S 41/148*** | (2018.01) |
| ***F21S 41/32*** | (2018.01) |
| ***F21S 41/20*** | (2018.01) |
| *F21W 102/155* | (2018.01) |
| *F21W 102/13* | (2018.01) |

(52) U.S. Cl.
CPC ..... *F21S 41/321* (2018.01); *F21W 2102/13* (2018.01); *F21W 2102/155* (2018.01)

(56) References Cited

U.S. PATENT DOCUMENTS

| | | | | |
|---|---|---|---|---|
| 8,256,940 | B2 * | 9/2012 | Brown | F21S 41/645 362/509 |
| 2004/0136200 | A1 | 7/2004 | Bos et al. | |
| 2015/0036373 | A1 * | 2/2015 | Chen | F21S 41/645 362/520 |
| 2017/0343173 | A1 | 11/2017 | Takada et al. | |
| 2017/0350568 | A1 | 12/2017 | Hager et al. | |
| 2019/0360655 | A1 | 11/2019 | Toko | |

FOREIGN PATENT DOCUMENTS

| | | | |
|---|---|---|---|
| EP | 1 431 654 | A1 | 6/2004 |
| EP | 1 523 431 | B1 | 8/2006 |
| EP | 2 143 994 | A1 | 1/2010 |
| EP | 2 199 664 | A1 | 6/2010 |
| EP | 2 711 611 | A1 | 3/2014 |
| FR | 3 084 728 | A1 | 2/2020 |

OTHER PUBLICATIONS

Written Opinion dated Apr. 20, 2021 in PCT/EP2021/053114 filed on Feb. 10, 2021 (citing references 2-4 & 15-22 therein, 10 pages).

* cited by examiner

MOTOR VEHICLE LIGHT MODULE COMPRISING AN ELECTROCHROMIC DEVICE

The invention relates to the field of automotive lighting. More precisely, the invention relates to the field of motor-vehicle lighting devices incorporating light-emitting modules the luminous signature of which remains constant both day and night and/or that are capable of performing a plurality of photometric functions.

The lighting devices, and in particular the front headlamps, of motor vehicles contribute greatly to the esthetic appearance of these vehicles. In particular, automobile manufacturers now style these lighting devices so that their luminous appearance allows them to be differentiated from other manufacturers, by virtue of a unique luminous signature created by the various lighting and signaling modules when they are turned on, both day and night.

At odds with this need to generate a unique luminous signature are regulatory constraints defining not only the perceived brightness of the light beams, no matter whether they are for signaling or lighting purposes, but also the period, i.e. night-time or daytime, during which these light beams must be emitted. It is thus for example that the DRL signaling function, DRL being the acronym of daytime running light, which must be turned on during the day, and high-beam and low-beam lighting functions, which must be turned on at night, are differentiated. These functions have different photometric distributions and cannot be activated simultaneously.

However, it is necessary to pool these various functions as much as possible within the same light-emitting module, so as to reduce the cost and size of lighting devices.

It is also known to incorporate into lighting devices light-emitting modules comprising a plurality of selectively controllable light sources that thus make it possible to perform a plurality of photometric functions, such as, for example, high-beam or low-beam lighting functions.

Usually, this type of light-emitting module employs a projecting optical device, for example a lens or reflector, making it possible to project light beams suitable for performing these functions onto the road. For example, a first light source emits light rays to perform alone a low-beam lighting function and a second light source emits light rays to perform, with the light rays emitted by the first light source, a high-beam lighting function.

These photometric functions are governed by regulatory constraints that in particular define the perceived brightness of the light beams that perform them, i.e. the spatial distribution of the light of these light beams. In particular, regarding the low-beam lighting function, regulations require the light beam to be bounded by a top, horizontal for example, cutoff above which no glare-inducing light is permitted.

In order to form this top cutoff, it is known to add, to the light-emitting module, a shield intended to intercept some of the light rays emitted by the first light source and the front edge of which has a profile of same shape as this cutoff, the projecting device having a focus disposed on this front edge. However, this shield must be positioned very precisely, so that the focus of the projecting optical device is correctly positioned on the front edge. Furthermore, the shield increases the weight of the light-emitting module and its bulk.

As a variant, in order to simplify the production of the light-emitting module and to decrease its bulk, it is known to associate each light source with a collector of reflector type, a rear edge of which forms said cutoff, one portion of the projecting optical device specific to the light source in question being focused in this case on the rear edge of the associated collector. However, this type of light-emitting module generally requires an opaque screen to be arranged horizontally in the module so as to prevent stray rays emitted by the first light source from being projected, by the portion of the projecting optical device specific to the second light source, above the top cutoff. This opaque screen increases the bulk of the light-emitting module.

Lastly, the appearance of these types of modules when turned on varies depending on the photometric function being performed. Specifically, in the case of a projecting lens, only one portion of the lens is illuminated when a low-beam lighting function is being performed, whereas the entire lens is illuminated when a high-beam lighting function is being performed. In addition, these modules do not allow signaling functions, in particular daytime signaling functions, to be performed. Therefore, it is not possible to obtain, with these types of module, in particular both day and night, a unique luminous signature.

There is thus a need for a light-emitting module, of a motor-vehicle lighting device, that has a unique luminous signature, which on the whole remains constant both day and night, that is capable of participating in the performance of various different photometric functions, and that has a limited horizontal bulk.

The present invention falls within this context and aims to meet this need.

To these ends, one subject of the invention is a light-emitting module for a motor-vehicle lighting device, comprising: a light source intended to participate in the performance of at least one photometric function; an electrochromic device comprising at least one segment arranged downstream of the light source and capable of selectively having a scattering aspect and a transparent aspect; and a controller arranged to receive an instruction to emit said photometric function and to control, depending on said instruction, the emission of light by the light source and the appearance of the electrochromic device.

Advantageously, the light source is intended to participate in the performance of at least a first photometric function and second photometric function and the controller is arranged to receive an instruction to emit either of the first and second photometric functions and to control, depending on said instruction, the emission of light by the light source and the appearance of the electrochromic device.

According to the invention, the electrochromic device, when it is transparent, is capable of letting the light emitted by the light source pass without deflecting it substantially, to participate in the performance of all or part of one of the photometric functions. Moreover, when it is scattering, the electrochromic device is capable of deflecting this light to obtain another photometric distribution and thus to participate in the performance of all or part of the other of the photometric functions. Thus, the module according to the invention is capable of performing different photometric functions via the same exit face of the light-emitting module, so that nevertheless it is possible to obtain a luminous signature that is constant on the whole, for example both day and night.

By electrochromic device, what is meant is a device comprising a layer of electrochromic material the optical properties of which, and in particular the opacity of which, change when a voltage or an electric current is applied thereto. For example, said layer of electrochromic material may be encapsulated between various layers, in particular layers forming electrodes and layers forming substrates. It will be noted that the scattering or transparent aspect of the electrochromic device persists in the absence of electrical power. If so desired, the electrochromic device may be a flexible screen or film. For example, the controller is arranged to control the supply of electrical power to the electrochromic device, and in particular to the layers forming the electrodes of this electrochromic device, in order to control its appearance. According to one example, the electrochromic device will possibly have the scattering aspect in the absence of voltage across the terminals of these layers forming the electrodes, and the transparent aspect when a voltage is present across the terminals of these layers forming the electrodes.

By electrochromic device arranged downstream of the light source, what is meant is an electrochromic device arranged on the optical path of the light emitted by this light source, directly or after deflection by an optical device, toward the exterior of the light-emitting module, so that all or some of this light passes therethrough. Preferably, the electrochromic device on the whole lies in a plane that is passed through by, in particular in a substantially perpendicular manner, an optical axis of the light-emitting module.

In one embodiment of the invention, the first photometric function is a statutory daytime running light and the second photometric function is a statutory road-lighting function, in particular a statutory low beam, a statutory high beam or even a segmented or pixelated high beam. Where appropriate, the controller is arranged to control the electrochromic device so that the electrochromic device has a scattering aspect on receipt of an instruction to emit the first photometric function and so that the electrochromic device has a transparent aspect on receipt of an instruction to emit the second photometric function. In other words, on receipt of an instruction to emit the second photometric function, the electrochromic device has substantially no impact on the photometric distribution of the light beam produced by means of the light emitted by the source. An optical device may thus be freely associated with this light source to obtain a photometric distribution meeting the regulatory requirements for the second photometric function. In contrast, on receipt of an instruction to emit the first photometric function, the electrochromic device, by virtue of its scattering aspect, spreads this light beam to obtain a photometric distribution compatible with the regulatory requirements for the daytime-running-light function.

Advantageously, the controller is arranged to control the supply of electrical power to the light source, and the controller is arranged to control the electrical power supplied to the light source to its nominal value on receipt of an instruction to emit the first photometric function.

Where appropriate, the controller may be arranged to control the electrical power supplied to the light source to a value higher than or equal to its nominal value on receipt of an instruction to emit the second photometric function. In the case of a value equal to the nominal value, control of the supply of electrical power is simplified. In the case of a value higher than the nominal value, the loss of efficacy caused by optical losses due to the passage of the light through the electrochromic device is compensated.

In one embodiment of the invention, the light-emitting module comprises a projecting optical device arranged to receive light emitted by the light source and to project this light onto the road, and the electrochromic device is arranged downstream of the projecting optical device. By projecting device, what is meant, for example, is a device, comprising one or more lenses and/or one or more reflectors, that is arranged to receive, directly or indirectly, light emitted by the light source, and that defines an exit face of light from the light-emitting module. If so desired, the electrochromic device may be arranged between the projecting optical device and a closing outer lens of a motor-vehicle lighting device incorporating the light-emitting module according to the invention.

In another embodiment of the invention, the light-emitting module comprises a collecting optical device arranged to form light emitted by the light source into an intermediate light beam and a projecting optical device arranged to receive the intermediate light beam and to project it onto the road, the electrochromic device being arranged between the collecting optical device and the projecting optical device. For example, the collecting optical device will possibly comprise one or a combination of a plurality of the following elements: reflector, lens, collimator, light guide, this or these elements being arranged to collect the light emitted by the light source.

Advantageously, the collecting optical device may comprise a reflective surface configured to collect and reflect light rays emitted by the light source, and the projecting optical system may be configured to project light rays reflected by the reflective surface in a light beam along an optical axis of the light-emitting module. Where appropriate, the light beam performs the first photometric function when the electrochromic device has a scattering aspect and the second photometric function when the electrochromic device has a transparent aspect.

For example, the projecting optical device may be configured to form a luminous image of the reflective surface of the collecting optical device so that the light beam exhibits a top horizontal cutoff. Advantageously, said top horizontal cutoff is formed by the rear edge of the reflective surface of the projecting optical device, the projecting optical device having a focus disposed in the vicinity of this rear edge. If so desired, said top horizontal cutoff may be a statutory low-beam cutoff. As a variant, the projecting optical device may be configured to form an image of the reflective surface of the collecting optical device so that the light beam exhibits a bottom horizontal cutoff. According to another variant, the projecting optical device may be configured to form an image of the reflective surface of the collecting optical device so that the light beam takes the form of a luminous pixel.

In another embodiment of the invention, the light source is a first light source and the segment of the electrochromic device is a first segment of the electrochromic device, characterized in that it comprises: a second light source, each of the first light source and second light source being intended to participate in the performance of a first photometric function and second photometric function, respectively; a projecting optical device configured to project the light rays emitted by the first light source and second light source in a first light beam and second light beam along an optical axis of the device, respectively; a second segment arranged downstream of the second light source, the second segment being capable of selectively having a scattering aspect and a transparent aspect; and in that the controller is arranged to receive an instruction to emit either of the first and second photometric functions and to control, depending on said instruction, the emission of light by the first light source and/or second light source and the appearance of the first segment and/or second segment of said electrochromic device.

According to the invention, each segment of the electrochromic device, when it is transparent, is capable of letting light emitted by the light source with which it is associated pass without deflecting it substantially, to thus participate in the performance of the first or second photometric function. Moreover, when it is scattering, the electrochromic device is capable of deflecting this light. It is thus possible to modify the photometric distribution of the first light beam and/or second light beam to obtain distributions compatible with luminous signaling functions. Furthermore, it is possible to intercept or scatter stray rays emitted by one of the light sources toward the segment of the electrochromic device associated with the other of the light sources (these stray rays might otherwise cause discomfort glare and therefore contravene regulatory requirements). Moreover, in the case where only one of the light sources needs to be activated to perform a photometric function, it is possible to activate the other light source so as to give the light-emitting module an illuminated appearance similar to the one it has when both light sources need to be activated. Thus, the module according to the invention is capable of performing a plurality of photometric functions, both for lighting and signaling purposes, and allows a luminous signature that on the whole remains constant, both day and night, to be obtained. Lastly, since the horizontal bulk of the electrochromic device is smaller than that of a shield or an opaque screen, the total bulk of the light-emitting module is decreased.

By electrochromic device, what is meant is a device comprising a layer of electrochromic material the optical properties of which, and in particular the opacity of which, change when a voltage or an electric current is applied thereto. For example, said layer of electrochromic material may be encapsulated between various layers, in particular layers forming electrodes and layers forming substrates. It will be noted that the scattering or transparent aspect of the electrochromic device persists in the absence of electrical power. If so desired, the electrochromic device may be a flexible screen or film. Advantageously, the layer of electrochromic material may be common to the two segments of the electrochromic device, and each segment may comprise layers forming electrodes that are specific thereto, so that each segment may be controlled independently of the other. As a variant, each segment of the electrochromic device may comprise a layer of electrochromic material and layers forming electrodes that are specific thereto, all of these layers of the two segments being encapsulated between the same common layers forming substrates. For example, the controller is arranged to control the supply of electrical power to each segment of the electrochromic device, and in particular to the layers forming the electrodes of each segment of this electrochromic device, in order to control its appearance. According to one example, each segment of the electrochromic device will possibly have the scattering aspect in the absence of voltage across the terminals of the layers forming the electrodes of this segment, and the transparent aspect when a voltage is present across the terminals of these layers forming the electrodes.

By segment of an electrochromic device arranged downstream of a light source, what is meant is a segment of an electrochromic device arranged on the optical path of the light emitted by this light source, directly or after deflection by an optical device, toward the exterior of the light-emitting module, so that all or some of this light passes therethrough. Preferably, the electrochromic device on the whole lies in a plane that is passed through by, in particular in a substantially perpendicular manner, an optical axis of the light-emitting module.

The controller may comprise a device for controlling the supply of electrical power to each of the first and second light sources, the control device being capable of activating or deactivating this supply of electrical power or else of modifying the value of the electrical power supplied to each of the light sources.

In one embodiment of the invention, the controller is arranged to control, on receipt of an instruction to emit the first photometric function, the emission of light by the first light source, the first light beam performing the first photometric function. In other words, the first light source is intended to perform the first photometric function alone. It could for example be a question of a statutory low-beam lighting function, or even of a complementary high-beam lighting function intended to complement a low-beam function to form, together with the latter, a statutory high-beam function, or even of a luminous pixel of a segmented or pixelated low- or high-beam lighting function.

For example, the controller may be arranged to command the emission of light only by the first light source on receipt of an instruction to emit the first photometric function. As a variant, the controller may be arranged to command the emission of light by the first light source and second light source simultaneously on receipt of an instruction to emit the first photometric function. Where appropriate, the controller may be arranged to control the electrical power supplied to the first light source to a value higher than or equal to its nominal value and to control the electrical power supplied to the second light source to a value lower than its nominal value. In this way, the first light source emits enough light for the light-emitting module to perform the first photometric function while the amount of light emitted by the second light source is not enough to cause glare but enough for the entirety of the projecting optical device to receive light from the two light sources and for the light-emitting module to have, on the whole, an illuminated appearance.

Advantageously, the controller is arranged to control the electrochromic device so that the first segment has a transparent aspect and so that the second segment has a scattering aspect on receipt of an instruction to emit the first photometric function. It will thus be understood that the first segment of the electrochromic device has substantially no impact on the photometric distribution of the first light beam produced by means of the light emitted by the first light source. In addition, the scattering aspect of the second segment causes light rays emitted by the first source toward this second segment to be intercepted and scattered, thus avoiding projection of glare-inducing light. Lastly, in the case where the second light source also emits light, the second segment also scatters this light to prevent it from inducing glare.

In another, alternative or cumulative, embodiment, the controller is arranged to control, on receipt of an instruction to emit the second photometric function, simultaneous emission of light by the first light source and second light source, the first and second light beams together performing the second photometric function. In other words, the first light source and second light source are intended to perform the second photometric function together. It will possibly, for example, be a question of a statutory high-beam lighting function. Where appropriate, the controller may be arranged to control the electrical power supplied to the first light source to a value higher than or equal to its nominal value and to control the electrical power supplied to the second light source to a value higher than or equal to its nominal value.

Advantageously, the controller is arranged to control the electrochromic device so that the first segment and second segment have a transparent aspect on receipt of an instruction to emit the second photometric function. It will thus be understood that each segment of the electrochromic device has substantially no impact on the photometric distribution of the first or second light beam produced by means of the light emitted by the first or second light source.

In another, alternative or cumulative, embodiment, the first light source and second light source are intended to respectively participate together in the performance of a third photometric function. Where appropriate, the controller is arranged to control, on receipt of an instruction to emit the third photometric function, simultaneous emission of light by the first light source and second light source, the first and second light beams together performing the second photometric function. The controller further controls the electrochromic device so that the first segment and second segment have a scattering aspect. Where appropriate, the controller may be arranged to control the electrical power supplied to the first light source to a value higher than or equal to its nominal value and to control the electrical power supplied to the second light source to a value higher than or equal to its nominal value. In this way, each segment of the electrochromic device, by virtue of its scattering aspect, spreads the first and second light beams so as to obtain an overall photometric distribution compatible with the regulatory requirements of a luminous signaling function.

For example, the first photometric function will possibly be a statutory low-beam lighting function, the second photometric function will possibly be a statutory high-beam lighting function, and the third photometric function will possibly be a statutory daytime-running-light signaling function. A luminous signature that on the whole remains constant, both day and night, is thus obtained.

According to one example of embodiment of the invention, the light-emitting module comprises a first collecting optical device, or first collector, and a second collecting optical device, or second collector, each collecting optical device being arranged to collect light rays emitted by the first and second light sources, respectively, the projecting optical device being arranged to receive light rays collected by the collecting optical devices. Where appropriate, the electrochromic device is arranged between the collecting optical devices and the projecting optical device, and for example in the vicinity of the projecting optical device.

By projecting device, what is meant, for example, is a device, comprising one or more lenses and/or one or more reflectors, that is arranged to receive, directly or indirectly, light emitted by the light sources, and that defines an exit face of light from the light-emitting module. Likewise, the collecting optical device will possibly comprise one or a combination of a plurality of the following elements: reflector, lens, collimator, light guide, this or these elements being arranged to collect the light emitted by the corresponding light source.

Advantageously, each collecting optical device comprises a reflective surface configured to collect and reflect the light rays emitted by the first and second light sources, respectively. Where appropriate, the projecting optical device is configured to form a luminous image of the reflective surface of each of the collecting optical devices.

Advantageously, the first collector and the first light source are placed, with respect to the second collector and to the second light source, so that the luminous image of the reflective surface of the first collector is inverted, with respect to the optical axis, versus the luminous image of the reflective surface of the second collector. For example, the first collector and the first light source are located opposite, with respect to the optical axis, to the second collector and to the second light source.

Advantageously, the reflective surfaces of the first collector and second collector have an elliptical or parabolic profile. Preferably, each is a surface of revolution of said profile. The revolution is about an axis that advantageously is parallel to the optical axis. According to one variant, the reflective surface is a free-form surface or a swept surface or an asymmetric surface. It may also comprise a plurality of sectors. For example, the reflective surface of each of the first collector and second collector is concave and has, with respect to a general direction of propagation of the corresponding light beam, a front edge and a rear edge, said edges bounding in opposite directions the corresponding luminous image.

Advantageously, the projecting optical device has a first focus located axially behind a front limit of the reflective surface of the first collector, and/or a second focus located axially behind a front limit of the reflective surface of the second collector. For example, the first focus will possibly be located on a rear edge of the reflective surface of the first collector and the second focus will possibly be located on a rear edge of the reflective surface of the second collector.

According to one advantageous embodiment of the invention, the first and second light sources are placed on a common platen.

Advantageously, the projecting optical device comprises a lens having a first entrance face for receiving light rays emitted by the first light source and a second entrance face for receiving light rays emitted by the second light source, the first segment of the electrochromic device being arranged facing the first entrance face and the second segment of the electrochromic device being arranged facing the second entrance face. For example, each segment is placed in the vicinity of one entrance face of the lens. Where appropriate, the lens has an exit face common to the first and second entrance faces.

For example, the electrochromic device may be in one piece, the first and second segment being separated by a boundary. Where appropriate, the first and second entrance faces of the lens may adjoin in a junction region, said boundary being aligned with the junction region, and in particular with the optical axis.

If so desired, the first and second entrance faces are aligned perpendicular to the optical axis.

A further subject of the invention is a lighting device for a motor vehicle, comprising a light-emitting module according to the invention. The lighting device will possibly for example be arranged in a front headlamp of a motor vehicle.

The present invention will now be described by way of examples that are merely illustrative and that in no way limit the scope of the invention, and with reference to the accompanying illustrations, in which.

In the following description, elements that are identical in terms of structure or in terms of function and that appear in various figures have been designated with the same reference, unless otherwise indicated. Furthermore, the terms "front", "rear", "top" and "bottom" must be interpreted in the context of the orientation of the lighting device such as it has been shown, corresponding to normal use of the lighting device, such as for example when mounted in a motor vehicle.

Figure 1:
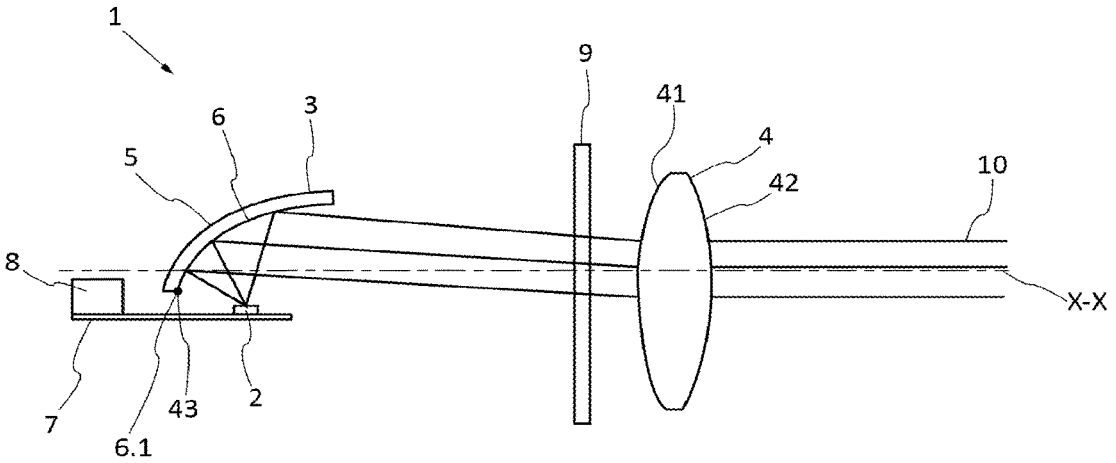
FIG. 1 shows, partially and schematically, a light-emitting module according to one embodiment of the invention operating under night-time conditions.

FIG. 1 shows a light-emitting module according to a first embodiment of the invention, when operating under night-time conditions.

The light-emitting module 1 comprises a light source 2, a collector 3 capable of reflecting the light rays emitted by the first light source in order to form a light beam 10 along an optical axis X-X of the module, and a lens 4 for projecting said beam. Projecting optical systems other than the projecting lens are envisionable, such as in particular one or more mirrors. If so desired, the light-emitting module will possibly comprise a second light source associated with another collector with a view to reflecting the light rays emitted by the second light source toward the lens 4 to form a second light beam along the optical axis X-X of the module.

The light source 2 is advantageously a semiconductor light source, such as in particular a light-emitting diode. This source 2 emits light rays in a half-space bounded by the main plane of said source 2, in the example shown in a main direction perpendicular to said plane and to the optical axis X-X.

The collector 3 comprises a carrier 5, of shell or skullcap shape, and a reflective surface 6 formed on the interior face of the carrier 5. The reflective surface 6 advantageously has an elliptical or parabolic profile. It is advantageously a surface of revolution about an axis parallel to the optical axis. Alternatively, it may be a question of a free-form surface or a swept surface or an asymmetric surface. It may also comprise a plurality of sectors. The shell- or skullcap-shaped collector 3 is advantageously made of materials that resist heat well, and for example of glass or of synthetic polymers such as polycarbonate PC or polyetherimide PEI. The expression "parabolic" generally applies to reflectors the surface of which has a single focus, i.e. one region of convergence of the light rays, i.e. one region such that the light rays emitted by a light source placed in this region of convergence are projected to a great distance after reflection from the surface. Projected to a great distance means that these light rays do not converge toward a region located at at least 10 times the dimensions of the reflector. In other words, the reflected rays do not converge toward a region of convergence or, if they do converge, this region of convergence is located at a distance larger than or equal to 10 times the dimensions of the reflector. A parabolic surface may therefore feature or not feature parabolic segments. A reflector having such a surface is generally used alone to create a light beam. Alternatively, it may be used as projecting surface associated with an elliptical reflector. In this case, the light source of the parabolic reflector is the region of convergence of the rays reflected by the elliptical reflector.

The light source 2 is placed at a focus of the corresponding reflective surface 6 so that the rays thereof are collected and reflected toward the lens 4.

The projecting lens 4 has an entrance face 41 for the light rays corresponding to the light beam 10, and an exit face 42 for this light beam 10. The lens 4 may have a focus 43 located on a region located between the reflective surface 6 of the collector 3 and the light source 2. In the present case, this focus 43 is on the reflective surface 6 of the collector 3. It will be noted that it is also possible for this focus to be located behind or in front of the reflective surface 6 provided that it is in proximity thereto, and preferably at less than 10 mm and preferably less than 5 mm therefrom.

The reflective surface, if it is elliptical, has a second focus located in front of the lens 4 and away from the optical axis X-X. It will be noted that it is also possible for this focus to be located behind the lens and/or on the optical axis, provided that it is in proximity to the lens, so as to decrease the width of the beam on the entrance face of the lens.

The light source 2 is mounted on a platen 7, a printed circuit board for example.

The light-emitting module 1 comprises a controller 8 capable of receiving an instruction to emit a given photometric function and arranged to control, depending on said instruction, activation of the light source 2 with a view to emitting the light beam 10. For this purpose, the controller 8 comprises a device for controlling the supply of electrical power to the light source 2, which is arranged to activate or deactivate this supply of electrical power or even to modify the value of the electrical power supplied to the light source 2.

The light-emitting module 1 comprises an electrochromic device 9 arranged downstream of the light source 2, between the collector 3 and the entrance face 41 of the lens 4. The electrochromic device 9 takes the form of a screen arranged on the whole in a plane passed through perpendicularly by the optical axis X-X, so that this screen is passed through by the light beam 10 after reflection from the reflective surface 6.

The electrochromic device 9 is formed by a stack of a plurality of layers including one or more layers of electrochromic material, tungsten trioxide for example, encapsulated between layers forming electrodes and layers forming transparent substrates. In a known manner, the opacity of the one or more layers of electrochromic material may be modified when electrical power is supplied to it or them. In this way, the electrochromic device may have a transparent aspect in which it lets light pass through it without substantially deflecting this light or a scattering aspect in which it scatters this light. According to the invention, the aspect of the electrochromic device 9 is controlled by the controller 8.

In the example shown, when the controller 8 receives an instruction to emit a lighting function, it controls the electrochromic device 9 so that the latter has a transparent aspect and it controls activation of the light source 2 so as to achieve the desired lighting function. For example, if the controller 8 receives an instruction to emit a low-beam lighting function, it controls activation of the light source 2 so that the light beam 10 is emitted and the electrochromic device 9 so that the latter has a transparent aspect.

Figure 2:
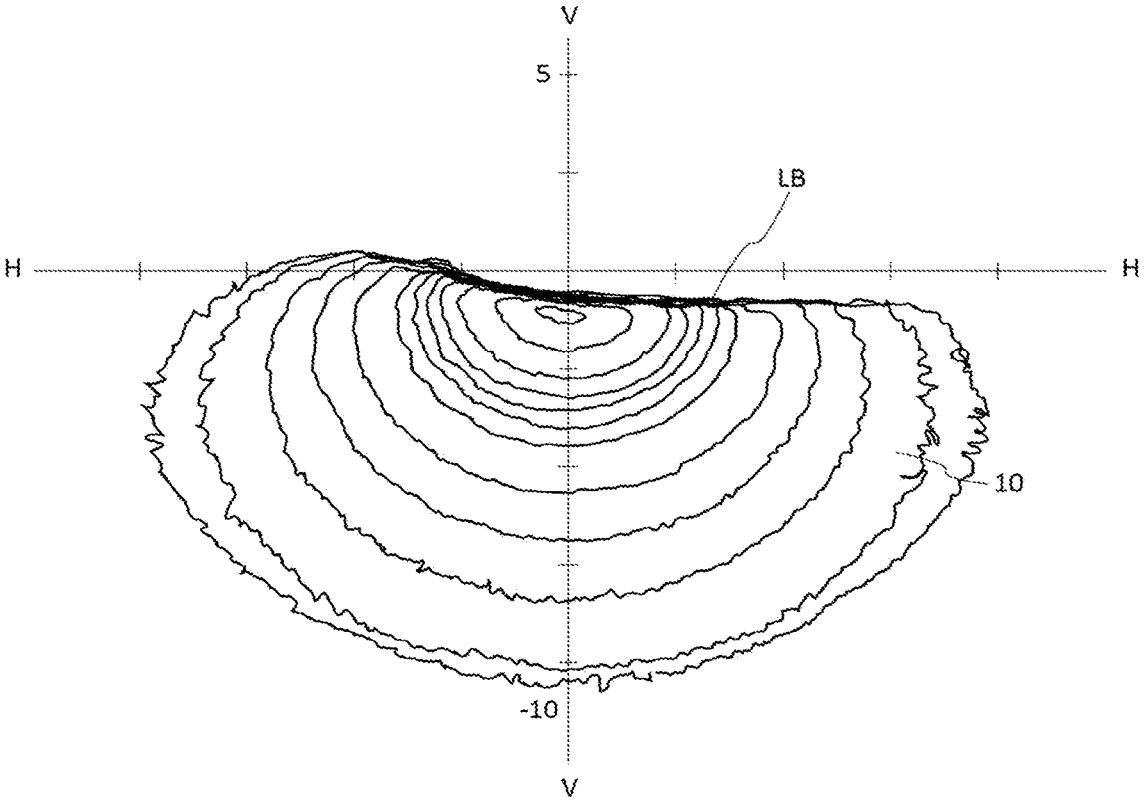
FIG. 2 shows isolux curves of a light beam emitted by the light-emitting module of FIG. 1.

FIG. 2 is a graphical representation of the images projected by the light-emitting module of FIG. 1 when the light source 2 is turned on and when the electrochromic device has a transparent aspect. The horizontal axis H and the vertical axis V cross on the optical axis of the light-emitting module. The curves shown are isolux curves, i.e. curves corresponding to regions of the light beam 10 that have the same luminance expressed in lux. The curves at the center correspond to a higher luminance level than on the periphery.

It may be seen that the light beam 10 has a top cutoff LB, essentially on the horizontal axis H. This top cutoff is a cutoff of the statutory low-beam type, produced by the rear edge 6.1 of the reflective surface 6 of the collector 3, as shown in FIG. 1. For this purpose, the focus 43 of the lens 4 is advantageously located in proximity to this edge 6.1, i.e. behind the light source 2. Advantageously, the light beam 10 reflected by the reflective surface 6 passes through the electrochromic device 9 before being projected by the lens 4. Due to the transparent aspect of the electrochromic device, the light beam 10 undergoes no substantial deflection on passing through this electrochromic device 9, and hence its photometric distribution, and in particular the top cutoff, is substantially not modified by this electrochromic device. In this way, the light beam 10 performs a photometric lighting function of the statutory low-beam type.

Advantageously, in order to compensate for optical losses caused by passage of the beam 10 through the electrochromic device 9, the controller 8 is arranged to control the electrical power supplied to the light source 2 to a value higher than the nominal value of this light source.

Figure 3:
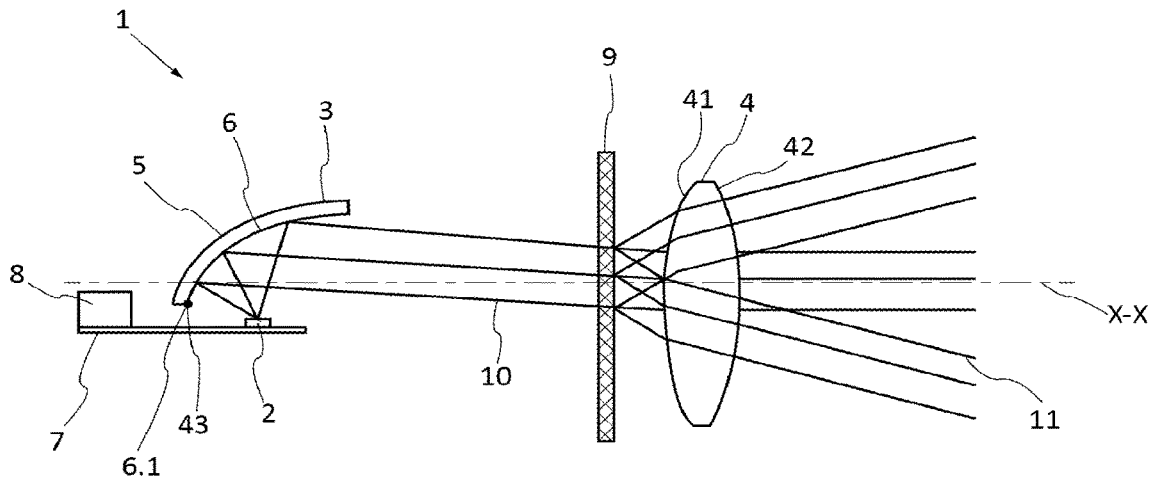
FIG. 3 shows, partially and schematically, the light-emitting module of FIG. 1 operating under daytime conditions.
Figure 4:
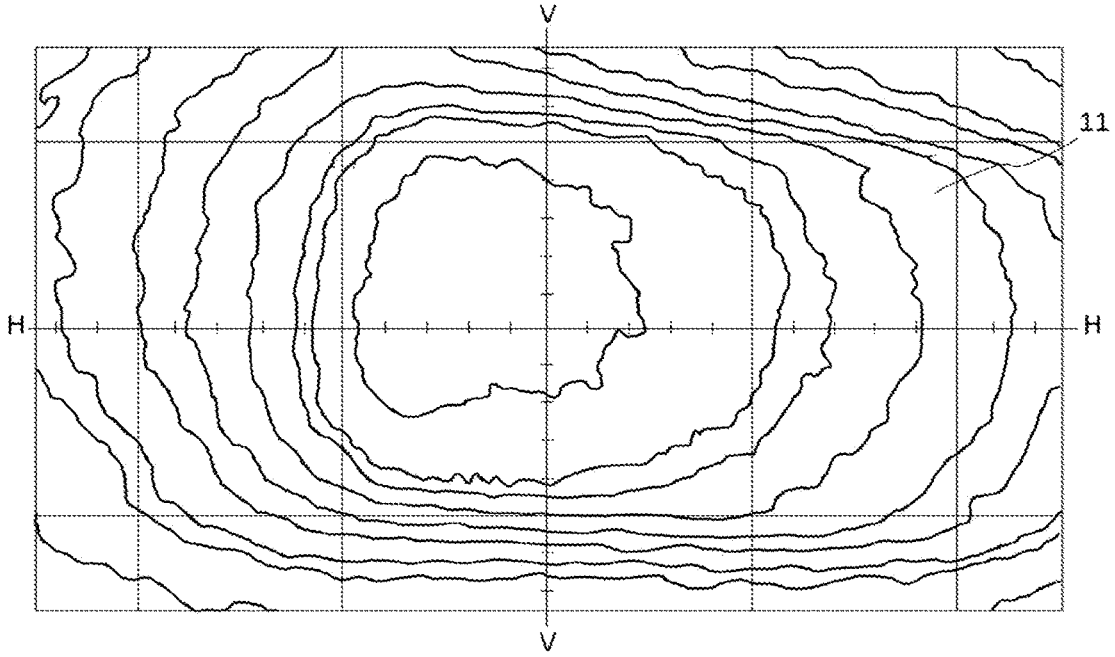
FIG. 4 shows isolux curves of a light beam emitted by the light-emitting module of FIG. 3.

With reference to FIG. 3 and FIG. 4, the operation of the light-emitting module 1 under daytime conditions will now be described.

As shown in FIG. 3, when the controller 8 receives an instruction to emit a daytime signaling function, it controls the electrochromic device 9 so that the latter has a scattering aspect and it controls activation of the source 2 so as to achieve the desired signaling function. For example, if the controller 8 receives an instruction to emit a DRL function (DRL standing for daytime running light), it controls activation of the light source 2 so that the light beam 10 is emitted. It will be noted that the light beam 10 reflected by the reflective surface 6 of the collector 3 thus has a substantially identical photometric distribution under both daytime and night-time conditions.

Advantageously, the light beam 10 reflected by the reflective surface 6 of the collector 3 passes through the electrochromic device 9 and undergoes, due to the scattering aspect of the electrochromic device 9, a deflection that spreads its photometric distribution vertically and horizontally. This modified beam 11 is thus projected by the projecting lens 4 with a view to performing another photometric function.

FIG. 4 is a graphical representation of the images projected by the light-emitting module of FIG. 3 when only the light source 2 is turned on and when the electrochromic device 9 has a scattering aspect.

It may be seen that the light beam 11 projected by the lens 4 after scattering by the electrochromic device 9 is devoid of any top cutoff and is substantially more spread out than the low beam shown in FIG. 2. This photometric distribution is thus compatible with the regulatory requirements of the DRL function.

It will be noted that this distribution may be obtained through the controller 8 controlling the electrical power supplied to the light source 2 to a value substantially equal to the nominal value of this light source.

Figure 5:
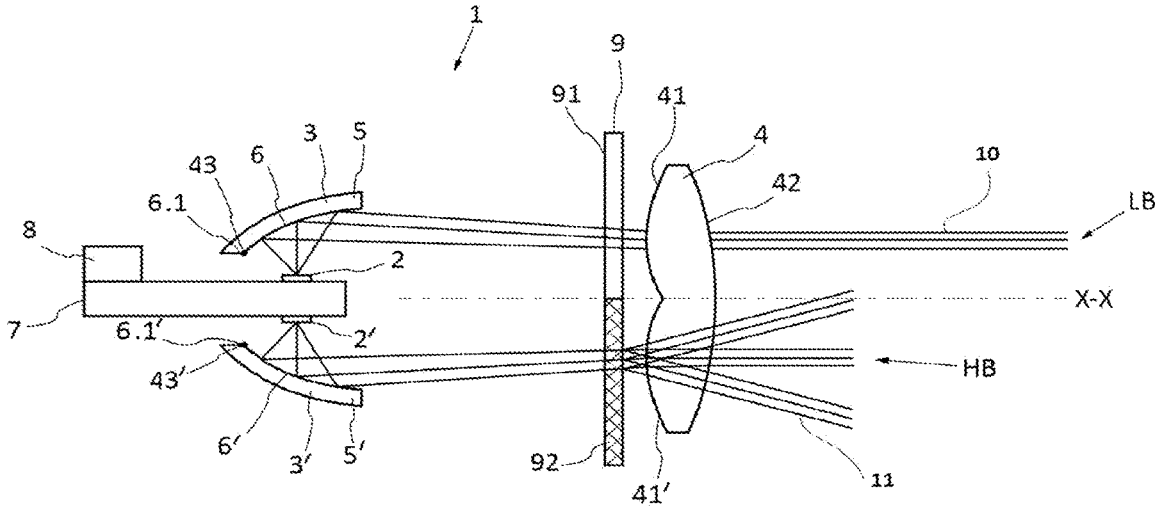
FIG. 5 shows, partially and schematically, a light-emitting module according to one embodiment of the invention operating in a first operating mode.

FIG. 5 shows a light-emitting module according to another embodiment of the invention, in a first operating mode.

The light-emitting module 1 comprises a first light source 2, a first collector 3 capable of reflecting the light rays emitted by the first light source in order to form a first light beam LB along an optical axis X-X of the module, and a lens 4 for projecting said beam. Projecting optical systems other than the projecting lens are envisionable, such as in particular one or more mirrors. The light-emitting module 1 further comprises a second light source 2' that is opposite, with respect to the optical axis X-X, to the first light source 2 and a second collector 3' that is also opposite to the first collector 3 and that is capable of reflecting the light rays emitted by the second light source 2' so as to form a second light beam HB along the optical axis X-X of the module.

The light sources 2 and 2' are advantageously semiconductor light sources, such as in particular light-emitting diodes. Each of the light sources 2 and 2' emits light rays in a half-space bounded by the main plane of said source, in the shown example in a main direction perpendicular to said plane and to the optical axis X-X.

Each of the collectors 3 and 3' comprises a carrier 5 and 5', of shell or skullcap shape, and a reflective surface 6 and 6' on the interior face of the carrier 5 and 5'. The reflective surfaces 6 and 6' advantageously have an elliptical or parabolic profile. At least one thereof is advantageously a surface of revolution about an axis parallel to the optical axis. Alternatively, it may be a question of a free-form surface or a swept surface or an asymmetric surface. It may also comprise a plurality of sectors. The shell- or skullcap-shaped collectors 3 and 3' are advantageously made from materials having a good heat resistance, for example of glass or of synthetic polymers such as polycarbonate PC or polyetherimide PEI. The expression "parabolic" generally applies to reflectors the surface of which has a single focus, i.e. one region of convergence of the light rays, i.e. one region such that the light rays emitted by a light source placed in this region of convergence are projected to a great distance after reflection from the surface. Projected to a great distance means that these light rays do not converge toward a region located at at least 10 times the dimensions of the reflector. In other words, the reflected rays do not converge toward a region of convergence or, if they do converge, this region of convergence is located at a distance larger than or equal to 10 times the dimensions of the reflector. A parabolic surface may therefore feature or not feature parabolic segments. A reflector having such a surface is generally used alone to create a light beam. Alternatively, it may be used as projecting surface associated with an elliptical reflector. In this case, the light source of the parabolic reflector is the region of convergence of the rays reflected by the elliptical reflector.

Each of the light sources 2 and 2' is placed at a focus of the corresponding reflective surface 6 and 6' so that the rays thereof are collected and reflected along the optical axis X-X.

The projecting lens 4 has a first entrance face 41 for the light rays corresponding to the first light beam LB, a second entrance face 41' for the light rays corresponding to the second light beam HB, and an exit face 42 common to the two entrance faces. The lens 4 may have a first focus 43 and a second focus 43', the first focus 43 corresponding to the top part of the lens 4 and the second focus 43' corresponding to the bottom part of the lens 4. Each of the first and second foci 43 and 43' in question is advantageously located in a region located between the reflective surface 6/6' of the corresponding first or second collector 3/3' and the corresponding first or second light source 2/2' (these regions have been bounded by dashed lines). In the present case, at least one of the foci may be located on the reflective surface 6/6' of the corresponding first or second collector 3/3'. It will be noted that it is also possible for this focus to be located behind or in front of the reflective surface 6/6' provided that it is in proximity thereto, and preferably at less than 10 mm and preferably less than 5 mm therefrom.

The reflective surface, if it is elliptical, has a second focus located in front of the lens 4 and away from the optical axis X-X. It will be noted that it is also possible for this focus to be located behind the lens and/or on the optical axis, provided that it is in proximity to the lens, so as to decrease the width of the beam on the entrance face of the lens.

Still with reference to FIG. 1, it may be seen that the first light source 2 and the first collector 3, on the one hand, and the second light source 2' and the second collector 3', on the other hand, are opposite with respect to the optical axis X-X. In particular, the first light source 2 is placed on one face of a carrier 7 and the second light source 2' is placed on an opposite face of the carrier 7. It is possible, for example, to place each light source on a platen, for example a printed circuit board, which is specific thereto, each platen being attached to the same heat sink. As a variant, the first and second light sources may be placed on opposite faces of a common platen.

The light-emitting module 1 comprises a controller 8 capable of receiving an instruction to emit a given photometric function and arranged to control, depending on said instruction, activation of the first light source 2 and/or second light source 2' with a view to emitting the first light beam LB and/or second light beam HB. For this purpose, the controller 8 comprises a device for controlling the supply of electrical power to the light sources 2 and 2' and is arranged to activate or deactivate this supply of electrical power or even to modify the value of the electrical power supplied to the light sources 2 and 2'.

The light-emitting module 1 comprises an electrochromic device 9 arranged downstream of the light sources 2 and 2', between the collectors 3 and 3' and the entrance faces 41 and 41' of the lens 4. The electrochromic device 9 takes the form of a screen arranged on the whole in a plane passed through perpendicularly by the optical axis X-X, so that this screen is passed through by the light beams LB and HB before these beam penetrate into the lens 4. More precisely, the electrochromic device 9 comprises a first segment 91 and second segment 92, which are placed on either side of the optical axis X-X, so that the first segment 91 is substantially passed through by the light beam LB and so that the second segment 92 is substantially passed through by the light beam HB, though certain light rays emitted by one of the light sources 2 and 2' may pass through the second segment 92 and first segment 91, respectively.

Each of the layers 91 and 92 of the electrochromic device 9 is formed by a stack of a plurality of layers including one or more layers of electrochromic material, tungsten trioxide for example, encapsulated between layers forming electrodes and layers forming transparent substrates. In a known manner, the opacity of the one or more layers of electrochromic material may be modified when electrical power is supplied to it or them. In this way, each layer 91 and 92 of the electrochromic device may have a transparent aspect in which it lets light pass through it without substantially deflecting this light or a scattering aspect in which it scatters this light. According to the invention, the aspect of each of the layers 91 and 92 of the electrochromic device 9 is controlled independently by the controller 8, depending on the received emit instruction.

In the operating mode shown in FIG. 5, the controller 8 receives an instruction to emit a low-beam lighting function. In response, it controls the first layer 91 of the electrochromic device 9 so that it has a transparent aspect and the second layer 92 so that it has a scattering aspect. The controller also controls activation of the first source 2 by supplying thereto an electrical power of value substantially identical to its nominal value, and activation of the second source 2' by supplying thereto an electrical power of value substantially lower than its nominal value.

Figure 6:
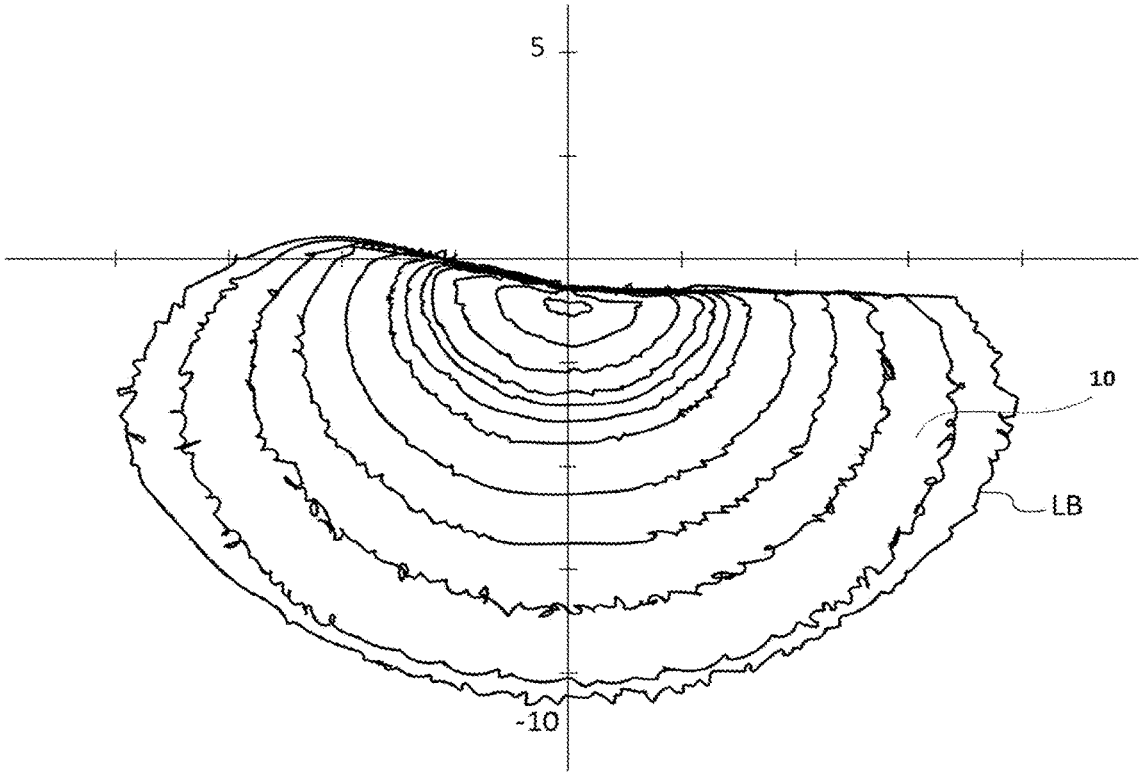
FIG. 6 shows isolux curves of a light beam emitted by the light-emitting module of FIG. 5.

FIG. 6 is a graphical representation of the images projected by the light-emitting module 1 in the operating mode of FIG. 5. The horizontal axis H and the vertical axis V cross on the optical axis of the light-emitting module. The curves shown are isolux curves, i.e. curves corresponding to regions of the light beam projected by the lens 4 that have the same luminance expressed in lux. The curves at the center correspond to a higher luminance level than on the periphery.

It may be seen that the first light beam LB has a top cutoff, essentially on the horizontal axis H. This top cutoff is a cutoff of the statutory low-beam type, produced by the rear edge 6.1 of the reflective surface 6 of the first collector 3, as shown in FIG. 5. For this purpose, the first focus 43 of the lens 4 is advantageously located in proximity to this edge 6.1, i.e. behind the first light source 2. Advantageously, the first light beam LB passes through the segment 92 of the electrochromic device 9 without being substantially deflected in any way, then penetrates into the lens 4 via the entrance face 41 and is projected onto the road. It may thus be seen that its photometric distribution, and in particular the top cutoff, is substantially not modified by this electrochromic device, and thus allows a first photometric function, namely a low-beam lighting function, to be performed.

Moreover, stray rays from the first light beam LB that reach the second segment 92 are scattered by this second segment, and hence even if some of these rays are projected by the lens 4 above the top cutoff, their brightness is decreased by this scattering and hence no discomfort glare is caused thereby.

Furthermore, the second light beam HB emitted by the second light source 2' and reflected by the second collector 3' has a low brightness given the low value of the electrical power received by the second light source 2'. This second light beam is intercepted by the second segment 92 and is also spatially spread, due to the scattering aspect of this second segment. Therefore, the light beam HB penetrates into the lens 4 via the entrance face 41' and is projected above the top cutoff of the beam LB, but with a brightness such that it does not cause discomfort glare, and hence the overall beam projected by the lens complies with the regulatory requirements for the low-beam lighting function. As such, neither the stray rays nor the light beam HB have been shown in FIG. 6. Lastly, it will be noted that the exit face 42 of the lens 4 is wholly illuminated by the beams LB and HB.

Figure 7:
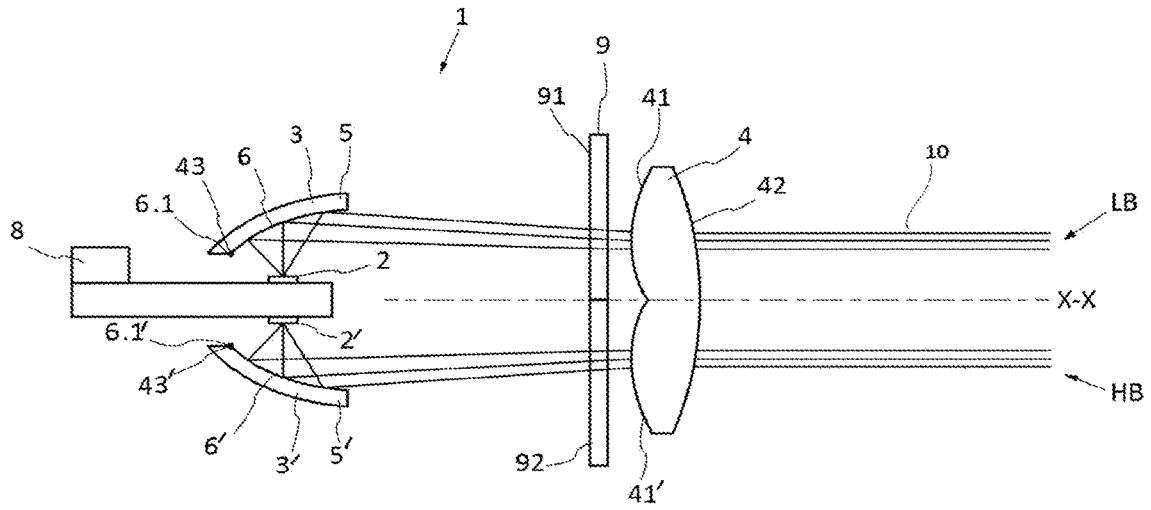
FIG. 7 shows, partially and schematically, the light-emitting module of FIG. 5 operating in a second operating mode.

FIG. 7 shows a second operating mode of the light-emitting module 1 of FIG. 5, in which the controller 8 receives an instruction to emit a high-beam lighting function. In response to this instruction, it controls the first layer 91 of the electrochromic device 9 so that it has a transparent aspect and the second layer 92 so that it also has a transparent aspect. The controller also controls activation of the first source 2 by supplying thereto an electrical power of value substantially identical to its nominal value, and activation of the second source 2' by supplying thereto an electrical power of value substantially identical to its nominal value.

Figure 8:
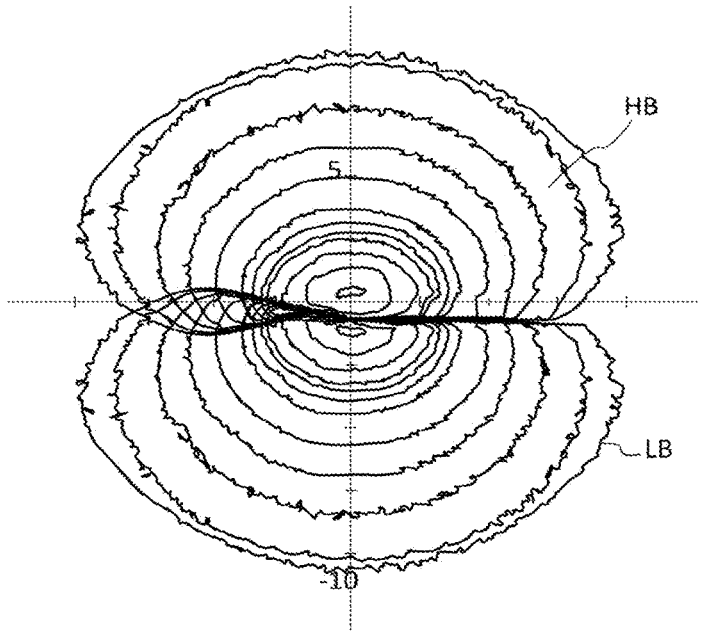
FIG. 8 shows isolux curves of a light beam emitted by the light-emitting module of FIG. 7.

FIG. 8 is a graphical representation of the images projected by the light-emitting module 1 in the operating mode of FIG. 7.

The second light beam HB extends substantially above the top cutoff of the beam LB, so as to complement this first light beam LB. This concentration of light above the top cutoff is achieved via the portion of the reflective surface 6' that is in proximity to the rear edge 6.1'. For this purpose, the second focus 43' of the lens 4 may be located in proximity to the rear edge 6.1'. Each light beam LB and HB thus passes through the first layer 91 and second layer 92 of the electrochromic device 9, respectively, without undergoing any substantial deviation, and thus penetrates the lens 4, via the entrance faces 41 and 41', respectively, so as to be projected onto the road. The combination of the first and second light beams LB and HB together thus forms a beam that complies with the regulatory requirements for the high-beam lighting function. The light-emitting module 1 thus performs a second photometric function, namely a high-beam lighting function. It will moreover be noted that the exit face 42 of the lens 4 is wholly illuminated by the beams LB and HB.

Figure 9:
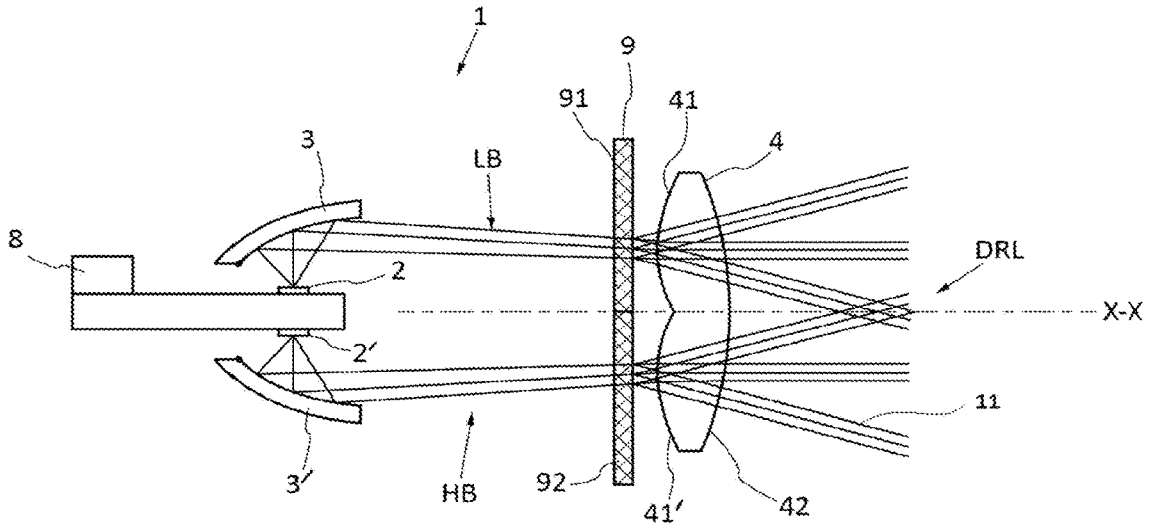
FIG. 9 shows, partially and schematically, the light-emitting module of FIG. 5 operating in a third operating mode.

FIG. 9 shows a third operating mode of the light-emitting module 1 of FIG. 5, in which the controller 8 receives an instruction to emit a DRL signaling function. In response to this instruction, it controls the first layer 91 of the electrochromic device 9 so that it has a scattering aspect and the second layer 92 so that it also has a scattering aspect. The controller also controls activation of the first source 2 by supplying thereto an electrical power of value substantially identical to its nominal value, and activation of the second source 2' by supplying thereto an electrical power of value substantially identical to its nominal value.

Under these conditions, it will be noted that the light beams LB and HB, reflected by the reflective surfaces 6 and 6', each have, before passing through the segments 91 and 92 of the electrochromic device 9, a photometric distribution substantially identical to those of FIG. 8.

Advantageously, each of the first and second light beams LB and HB passes through segments 91 and 92 of the electrochromic device 9, respectively, and undergoes, due to the scattering aspect of this segment, a deflection that spreads its photometric distribution vertically and horizontally, then penetrates into the lens 4 via the entrance faces 41 and 41', respectively, so as to be projected. Together the two projected beams thus form a DRL beam.

Figure 10:
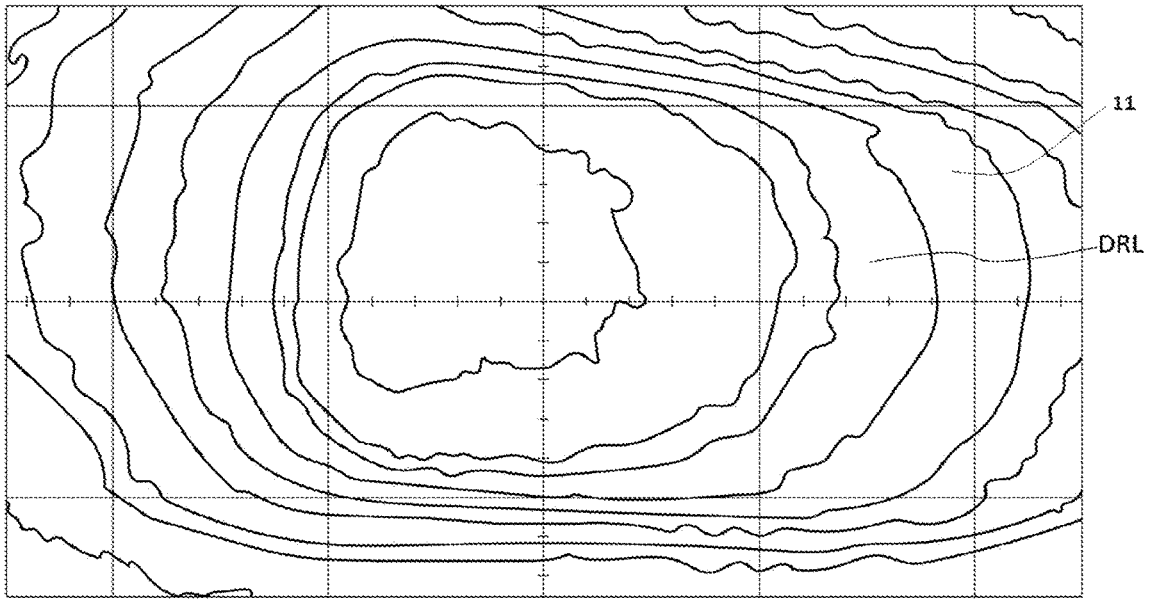
FIG. 10 shows isolux curves of a light beam emitted by the light-emitting module of FIG. 9.

FIG. 10 is a graphical representation of the images projected by the light-emitting module 1 in the operating mode of FIG. 9.

It may be seen that the DRL light beam projected by the lens 4 is devoid of any top cutoff and is far more spread out than the low beam shown in FIG. 6 or the high beam shown in FIG. 8. This photometric distribution is thus compatible with the regulatory requirements of the DRL function. The light-emitting module 1 thus performs a third photometric function, namely a DRL function. It will be noted that, in this third operating mode, the exit face 42 of the lens 4 is wholly illuminated by the beams LB and HB.

It will thus be understood that, by virtue of the invention and in particular by virtue of the use of an electrochromic device the aspect of which is controlled depending on the desired photometric function, the light-emitting module has a luminous signature, i.e. an appearance when turned on, that remains constant, both day and night, while allowing daytime and night-time photometric functions to be performed in accordance with the regulatory requirements for these functions. Likewise, by virtue of the invention and in particular by virtue of the use of an electrochromic device with two layers the aspect of which is controlled independently depending on the desired photometric function, the light-emitting module has a luminous signature, i.e. an appearance when turned on, that remains constant, both day and night, while allowing lighting and signaling photometric functions to be performed and while remaining compact overall.

In any event, the invention should not be regarded as being limited to the embodiments specifically described in this document, and extends, in particular, to any equivalent means and to any technically operative combination of these means. In particular, it is possible to envision arranging the electrochromic device in a different way to the one described—for example, it might be placed downstream of the projection lens. It is also possible to envision using the described light-emitting module for daytime and night-time functions other than those described, for example for segmented or pixelated low-beam or high-beam lighting functions. It is also possible to envision using the described light-emitting module for daytime and night-time functions other than those described, for example for segmented or pixelated low-beam or high-beam lighting functions and for direction-indicator-light or position-light signaling functions. Moreover, it is possible to envision integrating an electrochromic device into a light-emitting module having an optical structure different from that described, and in particular into a light-emitting module comprising a matrix array of light sources each associated with one primary optic, for example a collimator or microlens, the assembly formed therefrom being combined with a projecting optical system, for example one formed by a succession of projecting field lenses.

The invention claimed is:

1. A light-emitting module, comprising:

a light source configured to participate in the performance of at least one photometric function;

an electrochromic device comprising at least one segment arranged downstream of the light source and capable of selectively having a scattering aspect and a transparent aspect;

a controller configured to receive an instruction to emit said photometric function and to control, depending on said instruction, the emission of light by the light source and the appearance of the electrochromic device;

a reflective surface configured to collect and reflect light rays emitted by the light source; and a projecting lens arranged downstream of the electrochromic device to project a light beam, wherein the projecting lens has a focus located adjacent to an edge of the reflective surface so that the light beam has a horizontal cut-off when the electrochromic device has the transparent aspect.

2. The light-emitting module as claimed in claim 1, wherein:

the light source is configured to participate in the performance of at least a first photometric function and a second photometric function, and the controller is configured to receive an instruction to emit either of the first and second photometric functions and to control, depending on said instruction, the emission of light by the light source and the appearance of the electrochromic device.

3. The light-emitting module as claimed in claim 2, wherein:

the first photometric function is a statutory daytime running light, the second photometric function is a statutory road-lighting function, and the controller is configured to control the electrochromic device so that the electrochromic device has a scattering aspect on receipt of an instruction to emit the first photometric function and so that the electrochromic device has a transparent aspect on receipt of an instruction to emit the second photometric function.

4. The light-emitting module as claimed in claim 2, the light-emitting module comprising a projecting optical device arranged to receive light emitted by the light source and to project this light onto the road.

5. The light-emitting module as claimed in claim 2, the light-emitting module comprising:

a collecting optical device configured to form light emitted by the light source into an intermediate light beam; and a projecting optical device configured to receive the intermediate light beam and to project the intermediate light beam onto the road, wherein the electrochromic device is arranged between the collecting optical device and the projecting optical device.

6. The light-emitting module as claimed in claim 1, further comprising a projecting optical device configured to receive light emitted by the light source and to project the light onto the road.

7. The light-emitting module as claimed in claim 1, further comprising:

a collecting optical device configured to form light emitted by the light source into an intermediate light beam; and a projecting optical device configured to receive the intermediate light beam and to project it onto the road, wherein the electrochromic device is arranged between the collecting optical device and the projecting optical device.

8. The light-emitting module as claimed in claim 7, wherein the collecting optical device comprises a reflective surface configured to collect and reflect the light rays emitted by the light source, the projecting optical system being configured to project the light rays reflected by the reflective surface in a light beam along an optical axis of the device, the light beam performing the first photometric function when the electrochromic device has a scattering aspect and the second photometric function when the electrochromic device has a transparent aspect.

9. A lighting device for a motor vehicle, comprising a light-emitting module as claimed in claim 1.

10. A light-emitting module, comprising:

a first light source and a second light source, each of the first light source and the second light source being configured to participate in the performance of a first photometric function and a second photometric function, respectively;

a projecting optical device configured to project the light rays emitted by the first light source and the second light source in a first light beam and second light beam along an optical axis of the device, respectively;

an electrochromic device comprising a first segment arranged downstream of the first light source and capable of selectively having a scattering aspect and a transparent aspect and a second segment arranged downstream of the second light source and capable of selectively having a scattering aspect and a transparent aspect; and a controller configured to receive an instruction to emit either of the first and second photometric functions and to control, depending on said instruction, the emission of light by the first light source and/or the second light source and the appearance of the first segment and/or the second segment of said electrochromic device.

11. The light-emitting module as claimed in claim 10, wherein the controller is configured to control, on receipt of an instruction to emit the first photometric function, the emission of light by the first light source, the first light beam performing the first photometric function.

12. The light-emitting module as claimed in claim 11, wherein the controller is configured to control the electrochromic device so that the first segment has a transparent aspect and so that the second segment has a scattering aspect on receipt of an instruction to emit the first photometric function.

13. The light-emitting module as claimed in claim 10, wherein the controller is configured to control, on receipt of an instruction to emit the second photometric function, simultaneous emission of light by the first light source and second light source, the first and second light beams together performing the second photometric function.

14. The light-emitting module as claimed in claim 13, wherein the controller is configured to control the electrochromic device so that the first segment and second segment have a transparent aspect on receipt of an instruction to emit the second photometric function.

15. The light-emitting module as claimed in claim 10, wherein:

the first light source and second light source are respectively configured to participate together in the performance of a third photometric function, and the controller is configured to control, on receipt of an instruction to emit the third photometric function, simultaneous emission of light by the first light source and the second light source, the first and second light beams together performing the second photometric function, and to control the electrochromic device so that the first segment and second segment have a scattering aspect.

16. The light-emitting module as claimed in claim 15, wherein:

the first photometric function is a statutory low-beam lighting function, the second photometric function is a statutory high-beam lighting function, and the third photometric function is a statutory daytime-running-light signaling function.

17. The light-emitting module as claimed in claim 10, the light-emitting module comprising a first collecting optical device and a second collecting optical device, each collecting optical device being configured to collect the light rays (LB, HB) emitted by the first and second light sources, respectively, the projecting optical device being configured to receive the light rays collected by the collecting optical devices, the electrochromic device being arranged between the collecting optical devices and the projecting optical device.

18. The light-emitting module as claimed in claim 17, wherein the projecting optical device comprises a lens having a first entrance face for receiving the light rays emitted by the first light source and a second entrance face for receiving the light rays emitted by the second light source, the first segment of the electrochromic device being arranged facing the first entrance face and the second segment of the electrochromic device being arranged facing the second entrance face.

19. The light-emitting module as claimed in claim 10, wherein the controller is configured to control, on receipt of an instruction to emit the second photometric function, simultaneous emission of light by the first light source and the second light source, the first and second light beams together performing the second photometric function.

20. A light-emitting module, comprising:

a first light source configured to participate in the performance of a first photometric function;

a second light source configured to participate in the performance of a second photometric function;

an electrochromic device comprising at least two independent segments that are arranged downstream of the first light source and the second light source and are independently capable of selectively having a scattering aspect and a transparent aspect; and a controller configured to receive an instruction to emit at least one of the first photometric function or the second photometric function and to control, depending on said instruction, the emission of light by at least one of the first light source or the second light source and the appearance of the at least two independent segments of the electrochromic device.

* * * * *